United States Patent [19]

Reynolds

[11] 4,108,531

[45] Aug. 22, 1978

[54] FUSE HOLDER ASSEMBLY FIELD CONVERTIBLE FROM FUSE NON-REJECTING TO REJECTING MODES

[75] Inventor: Howard Reynolds, New Britain, Conn.

[73] Assignee: General Electric Company, Plainville, Conn.

[21] Appl. No.: 833,790

[22] Filed: Sep. 16, 1977

[51] Int. Cl.[2] ..... H01H 85/24

[52] U.S. Cl. ..... 339/258 F; 337/226; 339/259 F

[58] Field of Search ..... 339/31 R, 184 R, 186 R, 339/252 F, 253 F, 256 C, 258 F, 259 F; 337/215, 225, 226, 227

[56] References Cited

U.S. PATENT DOCUMENTS 3,198,913 8/1965 Stanback ..... 339/258 F

*Primary Examiner*—Neil Abrams

*Attorney, Agent, or Firm*—Robert A. Cahill; Walter C. Bernkopf; Frank L. Neuhauser

[57] ABSTRACT

A fuse holder assembly includes a fuse clip having clamping arms which define a pocket for receiving a fuse terminal ferrule. A rejection member equipped with an interference element is slideably mounted for movement between a non-rejecting position and a rejecting position with the interference element disposed within the clip pocket to obstruct the insertion of a fuse terminal ferrule which is not specially keyed with an annular groove. The rejection member further includes resilient tabs or barbs which are activated upon movement of the rejection member to its rejecting position to lock the rejection member thereat.

12 Claims, 10 Drawing Figures

FUSE HOLDER ASSEMBLY FIELD CONVERTIBLE FROM FUSE NON-REJECTING TO REJECTING MODES

BACKGROUND OF THE INVENTION

The present invention relates generally to fuse holders and, more particularly to cartridge fuse holders capable of rejecting improper fuses.

Cartridge fuses are available in a variety of current ratings and interrupting capacities (IC). At least in one case, cartridge fuses of the same current rating but of different interrupting capacity are of substantially the same physical size. Specifically, the current limiting, high IC class R cartridge fuse is essentially identical in physical dimensions to the non-current limiting, low IC class H cartridge fuse. Consequently, the class H and class R fuses are interchangeable insofar as the fuse holder is concerned. Obviously, they are not interchangeable from the standpoint of circuit protection. If a class H fuse is inadvertently inserted in a fuse holder installed in a circuit calling for class R fuse protection, a potentially hazardous situation is created. To discourage this from occurring, industry has resorted to keying one end terminal of the class R fuse and a specially designed rejection fuse holder which accepts the keyed end terminal of a class R fuse but does not accept the unkeyed end terminal of a class H fuse. In the case of class R fuses having ferrule type end terminals, keying is achieved by machining an appropriately dimensioned annular groove in one of the terminal ferrules. The rejection fuse holder is then provided with an interference member which is accommodated in the annular groove of a class R fuse terminal ferrule as it is inserted between the clamping arms. The interference member engages the ungrooved, smooth periphery of a class H fuse terminal ferrule to obstruct its insertion between the clamping arms. Rejection fuse holders of this type are exemplified in U.S. Pat. Nos. 2,943,295; 3,914,005; 3,960,435; 3,984,801 and 4,017,816.

Since both class R and class H fuses are widely used, manufacturers are forced into the uneconomical proposition of having to manufacture and stock both the rejecting and the non-rejecting types of fuse holders. Since the fuse holders are assembled in electrical equipment prior to shipment, the equipment itself must also be stocked or, alternatively, the type of fuses the equipment is to utilize must be known at the time of assembly.

To mitigate the additional manufacturing expense engendered by the necessity of supplying both types of fuse holders, manufacturers have resorted to providing with the equipment a basic non-rejecting type fuse holder capable of accepting both class H and class R cartridge fuses and offering a kit including a rejection member which is physicaly adapted to the fuse holder by the customer at the time the equipment is installed. Examples of this approach are illustrated in the above cited U.S. Pat. Nos. 3,984,801 and 4,017,816. Of course, requiring the customer to assembly a rejection member to a fuse holder in the field involves some time and effort typically on the part of relatively high-salaried electricians, and thus this approach constitutes an added expense to the customer over and above the cost of the kit. Since the electrical equipment involved typically has a plurality of fuse holders, the additional customer expense is not insignificant. Moreover, since the rejection member is assembled to the fuse holder in the field, the ability to readily defeat the rejection feature through subsequent disassembly of the rejection member becomes difficult to discourage. The inability to readily defeat a fuse rejection feature once it has been implemented is an Underwriters Laboratories requirement.

It is accordingly an object of the present invention to provide a fuse holder assembly which is readily field convertible from a fuse non-rejecting mode to a fuse rejecting mode.

A further object of the present invention is to provide a fuse holder assembly of the above character which, upon being converted from its non-rejecting mode to its rejecting mode, cannot be readily converted back to its non-rejecting mode.

Another object of the present invention is to provide a fuse holder assembly wherein the conversion from non-rejecting to rejecting modes does not require the addition of any structural elements to the assembly.

An additional object of the present inventon is to provide a fuse holder of the above character which is inexpensive to manufacture and is convertible from its non-rejecting to its rejecting modes with minimal time and effort.

Other objects of the invention will in part be obvious and in part appear hereinafter.

SUMMARY OF THE INVENTION

In accordance with the present invention, there is provided a fuse holder assembly which is readily convertible from a non-rejecting mode capable of accepting any fuse terminal ferrule to a rejecting mode capable of accepting only a fuse terminal ferrule keyed with a special recess and which, unlike prior art fuse holders, does not require the incorporation of additional parts into the assembly in effecting the conversion. More specifically, the fuse holder of the present invention includes a fixedly mounted fuse clip having a pair of spaced, generally parallel, flexible clamping arms defining therebetween a pocket for receiving a fuse terminal. A rejection member having an interference element is mounted for movement relative to the fuse clip from a non-rejecting position with said interference element removed from the pocket to a rejecting position with said interference portion disposed within the pocket to obstruct the full insertion of a fuse terminal lacking the special recess.

As an additional feature of the invention, the assembly further includes means activated upon movement of the rejection member to its rejecting position to obstruct movement of the rejection member back to its non-rejecting position. As a consequence, once the fuse holder assembly of the present invention has been converted to its fuse rejecting mode, the conversion is irreversible in that the fuse holder assembly cannot be readily converted back to its non-fuse rejecting mode. The Underwriters Laboratories requirement in this regard is thus satisfied.

In accordance with another feature of the present invention, the rejection member carries opposed reinforcement spring arms which act on the fuse clip clamping arms, regardless of the position of the rejection member, to enhance the clamping pressure exerted by the clamping arms on a fuse terminal accommodated in the pocket defined therebetween.

The invention accordingly comprises the features of construction, combinations of elements and arrangements of parts which will be exemplified in the constructions hereinafter set forth, the scope of the invention will be indicated in the claims.

For a full understanding of the nature and objects of the invention, reference should be had to the following detailed description taken in connection with the accompanying drawings, in which.

Corresponding reference numerals refer to like parts throughout the several views of the drawings.

DETAILED DESCRIPTION

Figure 1:
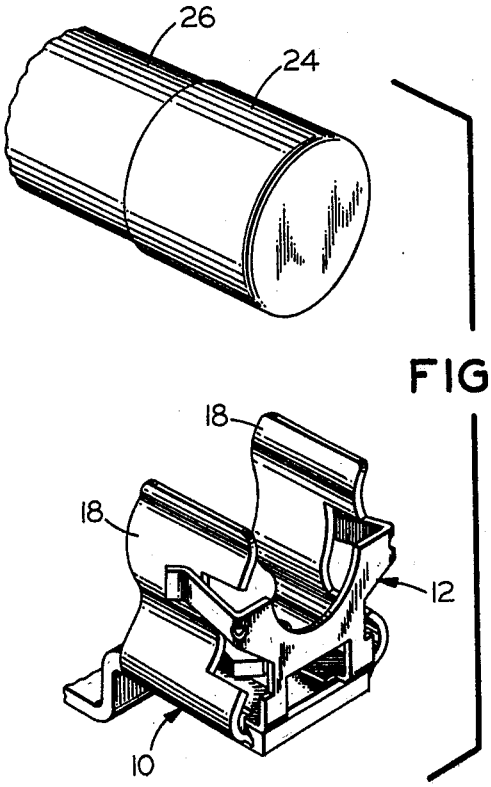
FIG. 1 is a perspective view of a fuse holder assembly constructed according to an embodiment of the present invention and shown in its non-rejecting mode.
Figure 2:
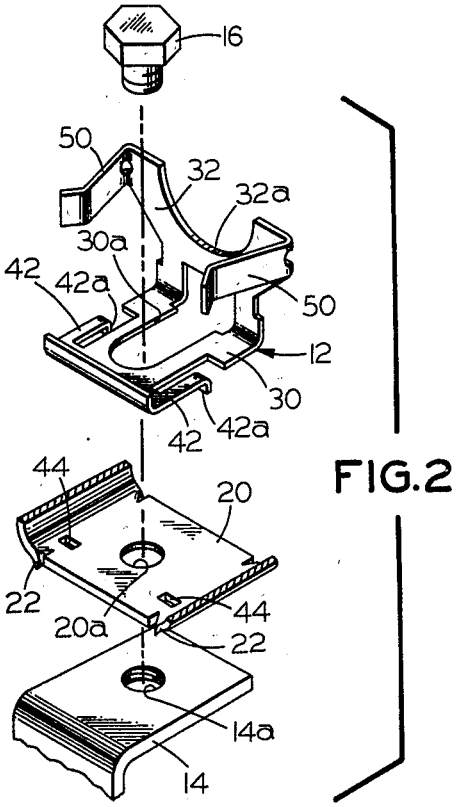
FIG. 2 is an exploded view, partially broken away, of the fuse holder assembly of FIG. 1.
Figure 6:
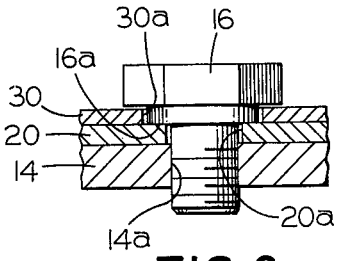
FIG. 6 is an enlarged sectional view taken along line 6—6 of FIG. 5.
Figure 7:
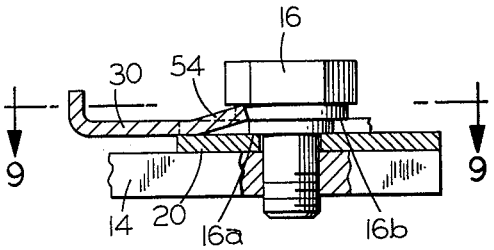
FIG. 7 is a fragmentary, side elevational view, partially in section, illustrating the fuse holder assembly of FIG. 1 in its rejecting mode and utilizing an alternative form of locking means for preventing reconversion of the fuse holder assembly to its non-rejecting mode.

The fuse holder assembly of the present invention, whose overall construction is best seen in FIGS. 1 and 2, includes a fuse clip, generally indicated at 10, and a rejection member, generally indicated at 12, which, in the illustrated embodiments of the invention, are secured to a conductive terminal strap 14 by a common bolt 16. Fuse clip 10, preferably formed of a highly conductive metal such as copper, includes a pair of upstanding, spaced, generally parallel flexible fuse terminal clamping arms 18 integrally joined by a base 20. Clamping arms 18 are provided with outwardly curved portions defining opposed concave contact surfaces for engaging the periphery of an end terminal ferrule 24 of a cartridge fuse 26. Clip base 20 includes a central clearance hole 20*a* through which the shank of bolt 16 passes for threaded engagement in a tapped hole 14*a* formed in terminal strap 14. As seen in FIG. 6, clip base 20 is clamped under shoulder 16*a* of bolt 16 in electrical contacting engagement with terminal strap 14. Barbs 22 struck from clip base 20 depend along the lateral edges of terminal strap 14 for anti-turn purposes.

Rejection member 12, preferably formed from spring steel sheet stock, is of generally L-shaped configuration having a base 30 and a bent-up interference element 32. An elongated slot 30*a* is formed in rejection member base 30 and extends upwardly into interference element 32. The width of this slot is sufficient to accommodate the penetration of bolt shoulder 16*a* into clamping engagement with clip base 20, as seen in FIG. 6. The rejection member, in turn, is held captive under the head of bolt 16. The height of bolt shoulder 16*a* is dimensioned so as to be slightly in excess of the thickness of base 30, and thus interference member 12 is free for sliding movement relative to the stationary clip 10.

The upper edge of interference element 32 is provided with a concave recess 32*a* having a radius of curvature which is less than the radius of curvature of the smooth peripheral surface of cylindrical fuse terminal ferrule 24, such as is the case for a class H fuse terminal ferrule. However, the radius of curvature of recess 32*a* is slightly greater than the radius of curvature of the peripheral surface at the bottom of an annular groove 36*a* keyed into the cylindrical fuse end terminal ferrule 36, such as in the case of a class R fuse 38 seen in FIG. 4.

Figure 3:
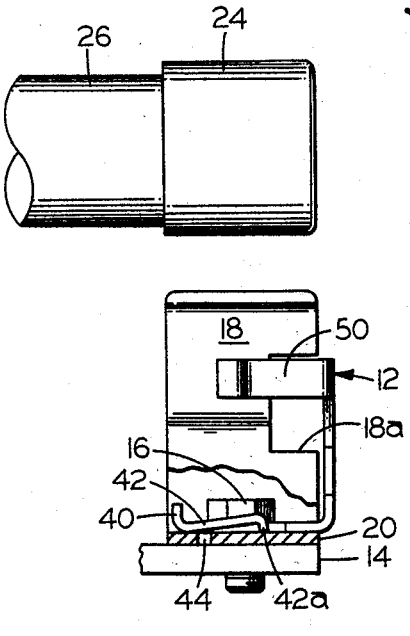
FIG. 3 is a side elevational view of a fuse holder assembly of FIG. 1, again as shown in its non-rejecting mode.
Figure 4:
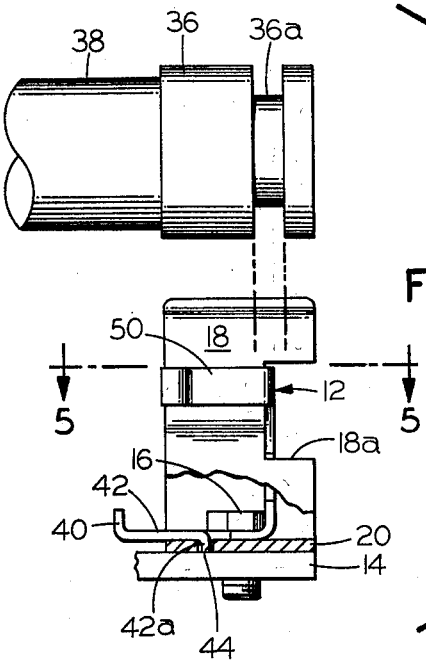
FIG. 4 is a side elevational view, partially broken away, of the fuse holder assembly of FIG. 1, shown converted to its fuse rejecting mode.
Figure 5:
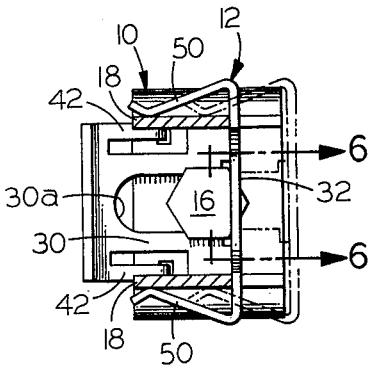
FIG. 5 is a sectional view taken along line 5—5 in FIG. 4 with the rejection member's non-rejection position of FIG. 4 illustrated in phantom.

Referring to FIGS. 3, 4 and 5, it is seen that with rejection member 12 in the position shown in FIG. 3 and in phantom in FIG. 5, interference element 32 is positioned beyond the back edges of clamping arms 18 in a non-rejecting position removed from the fused terminal receiving pocket defined by the clamping arms. As a consequence, the ungrooved terminal ferrule 24 of a class H fuse 26, as well as the grooved terminal ferrule of class R fuse 38, may be fully inserted into the fuse clip pocket between the clamping arms 18. On the other hand, when the fuse holder assembly is converted from its non-rejecting mode of FIG. 3 to its rejecting mode of FIG. 4 in accordance with the invention, wherein rejection member 12 is slid from its non-rejecting position seen in FIG. 4 and in solid line in FIG. 5, interference element 32 is disposed with the fuse terminal pocket between clamping arms 18. The rear vertical edges of clamping arms 18 are suitably notched, as indicated at 18*a*, to accommodate the entry of interference element 32 into the fuse terminal pocket. The upper edge of interference member 22 is thus in position to obstruct the insertion of an ungrooved class H fuse terminal ferrule. However, upon insertion of a class R fuse 38, the upper edge of interference member, by virtue of the concave recess 32*a* formed therein, is accommodated in annular groove 36*a* formed in the terminal ferrule 36, thereby permitting full insertion into the clip pocket of the class R fuse terminal ferrule.

In order to facilitate manually induced movement of rejection member 12 from its non-rejecting position to its rejecting position, the free end of its base 30 is bent upwardly to provide a flange 40. The blade of a conventional screwdriver may then be positioned between flange 40 and the head of bolt 16 and twisted to, in effect, cam rejection member 12 from its non-rejecting position of FIG. 3 to its rejection position of FIG. 4.

As an additional feature of the present invention, a portion at each side edge of base 30 for rejection member 12 is notched out to provide a pair of resilient tabs 42 having downwardly turned free ends 42*a*. From FIG. 3, it is seen that while rejection member 12 is in its non-rejecting position, the downwardly turned free ends 42*a* bear against the upper surface of clip base 20, causing tabs 42 to flex upwardly. When rejection member 12 is slid to its fuse rejecting position, the turned down ends 42*a* of tabs 42 drop into perforations 44 provided in clip base 20. It is seen that, with the tab free ends lodged in these perforations, rejection member 12 cannot be slid back to its non-rejecting position, thus satisfying the UL requirement that class R fuse rejection cannot be readily defeated. In the same context, with rejection member 12 in its rejecting position, the head of bolt 16 protrudes partially into the widened portion of slot 30*a* extending into interference element 32, thus precluding access of a wrench to the bolt head. Consequently, the fuse rejection mode cannot be readily defeated by dismantling the fuse holder assembly.

In accordance with still another feature of the present invention, rejection member 12 carries a pair of spring arms 50 extending horizontally from the upper corners of upright interference element 32. These spring arms are disposed to act against clamping arms 18 while rejection member is in either of its non-rejecting and rejecting positions to enhance the clamping pressure exerted by the clamping arms on a fuse terminal ferrule accommodated in the pocket defined therebetween.

Figure 8:
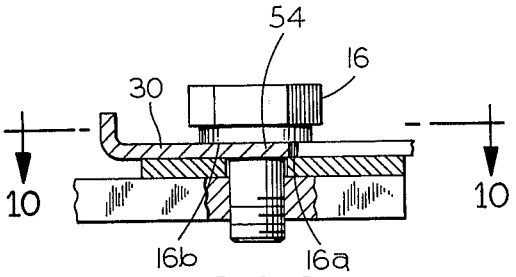
FIG. 8 is a fragmentary, side elevational view, partially in section, depicting the unactuated condition of the alternative locking means of FIG. 7.
Figure 9:
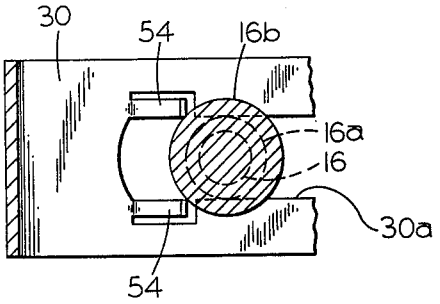
FIG. 9 is a sectional view taken along line 9—9 of FIG. 7.
Figure 10:
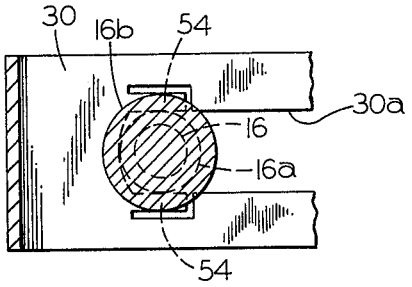
FIG. 10 is a sectional view taken along line 10—10 of FIG. 8.

FIGS. 7–10 are fragmentary views of a portion of the fuse holder assembly of FIG. 1 illustrating an alternative form of locking means for preventing movement of rejection member 12 from its rejecting position back to its non-rejecting position. Specifically, rather than providing tabs 42 in the base 30 of the rejection member, upwardly sprung barbs are formed in the rejection member base adjacent opposed edges of the elongated slot 30*a* formed therein. When using this construction, bolt 16 is preferably formed with an additional shoulder 16*b* located immediately beneath the bolt head. With the bolt in place, its lowermost shoulder 16*a* clamps the base 20 of clip 10 in electrical connection with strap 14, as in the embodiment of FIGS. 1–6. When the rejecting member 12 is in its non-rejecting position, as seen in FIGS. 8 and 10, barbs 54 are deflected downwardly into the plane of rejection member base 30 by shoulder 16*b*. When rejection member 12 is moved to its fuse rejecting position, barbs 54, being clear of bolt shoulder 16*b*, are free to spring upwardly to their positions seen in FIGS. 7 and 9. The free ends of these barbs are thus in positions to engage the peripheral side of bolt shoulder 16*b* and preclude movement of rejection member 12 back to its non-rejecting position. It will be noted from FIG. 7 that the bolt head partially obscures the barbs to discourage attempts to force them back into the plane of the rejection member base 30 in an effort to free the rejection member for movement back to its non-rejecting position. It will be appreciated that the function of bolt shoulder 16*b* could be served by a separate washer, preferably a Belleville washer, which would have the additional advantage of relaxing the tolerances in the height of shoulder 16*a*. In this context, a Belleville washer could be utilized under the head of bolt 16 in the embodiment of FIGS. 1–6.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. A fuse holder assembly field convertible from a non-rejecting mode capable of accepting a fuse terminal to a rejecting mode capable of accepting only a fuse terminal keyed with a special recess, said fuse holder assembly comprising, in combination:

A. a fixedly mounted fuse clip having a pair of spaced, generally parallel, flexible clamping arms defining therebetween a pocket for receiving a fuse terminal;

B. a rejection member having an interference element;

C. means movably mounting said rejection member for movement from a non-rejecting position with said interference element displaced from said pocket and both said clamping arms to a rejecting position with said interference portion disposed within said pocket to obstruct the full insertion therein of a fuse terminal lacking the special recess.

2. The fuse holder assembly defined in claim 1, which further includes means operating automatically upon movement of said rejection member from said non-rejection position to said rejection position to lock said rejection member against movement back to said non-rejecting position.

3. The fuse holder assembly defined in claim 1, which further includes spring means carried by said rejection member and acting on said clamping arms while said rejection member is in either of its non-rejecting and rejecting positions to enhance the contact pressure of said clamping arms on a fuse terminal accommodated in said pocket.

4. The fuse holder defined in claim 1, wherein said means movably mounting said rejection member also fixedly mounts said clip in electrical contacting engagement with a terminal strap.

5. The fuse holder defined in claim 3, which further includes means operating automatically upon movement of said rejection member from said non-rejection position to said rejection position to lock said rejection member against movement back to said non-rejecting position.

6. The fuse holder defined in claim 5, wherein said means movably mounting said rejection member also fixedly mounts said clip in electrical contacting engagement with a terminal strap.

7. A fuse holder assembly for adaptation to a device terminal strap, said assembly being field convertible from a non-rejecting mode capable of accepting a fuse terminal ferrule to a rejecting mode capable of accepting a fuse terminal ferrule specially keyed with an annular groove, said fuse holder assembly comprising, in combination:

A. a fuse clip having a pair of spaced, generally parallel, flexible clamping arms upstanding from an integral base, said clamping arms defining therebetween a pocket for receiving a fuse terminal ferrule, and said base having a hole therein;

B. an L-shaped rejection member having a base and an upstanding interference element arranged transversely to said clamping arms, said base being provided with an elongated slot and said interference element being provided with a concave recess in the upper edge thereof; said recess having a radius of curvature conforming to peripheral surface at the bottom of the annular groove in a keyed fuse terminal;

C. a fastener having a shank for extension through said slot in said rejection member base and said hole in said clip base into engaging relation with the device terminal strap, said fastener clamping said clip base in electrical connection with the device terminal strap and slideably mounting said rejection member for movement from a non-rejecting position with said interference element removed from said fuse terminal pocket to a rejecting position with said interference element disposed in said pocket to obstruct the full insertion therein of a fuse terminal ferrule lacking the annular groove.

8. The fuse holder assembly defined in claim 7, which further includes locking means automatically activated upon movement of said rejection member from its non-rejecting position to its rejecting position to impede movement of said rejection member back to its non-rejecting position.

9. The fuse holder assembly defined in claim 8, wherein said locking means comprises at least one resilient tab carried by said rejection member base and at least one perforation formed in said clip base, said tab having a turned down free end which bears against the upper surface of said clip base while said rejection member is in its non-rejecting position, to flex said tab upwardly, with said rejection member in its rejecting position, said tab free end drops into said clip base perforation to impede movement of said rejection member back to its non-rejection position.

10. The fuse holder assembly defined in claim 8, wherein said locking means comprises at least one upwardly sprung barb carried by said rejection member base, said barb being held down in the plane of said rejection member base by said fastener while said rejection member is in its non-rejecting position, with said rejection member in its rejecting position, said barb being freed to spring inwardly to a position where it engages said fastener to impede movement of said rejection member back to its non-rejecting position.

11. The fuse holder defined in claim 8, wherein said fastener is a headed screw fastener and said slot in said rejection member base includes an enlarged slot portion extending into said interference element, with said rejection member in its rejecting position, the head of said fastener protrudes through said enlarged slot portion, whereby said interference element impedes access to the fastener head.

12. The fuse holder defined in claim 8, which further includes spring arms carried by said interference element, said spring arms acting on said clamping arms, while said rejection member is in either of its non-rejecting positions, to enhance the clamping pressure exerted by said clamping arms on a fuse terminal ferrule accommodated in said pocket.

* * * * *

UNITED STATES PATENT OFFICE

CERTIFICATE OF CORRECTION

PATENT NO. : 4,108,531

DATED : August 22, 1978

INVENTOR(S) : Howard Reynolds

It is certified that error appears in the above-identified patent and that said Letters Patent are hereby corrected as shown below:

Column 4, line 36, change reference numeral "22" to --32--.

Column 8, line 19, after "non-rejecting" insert --and rejecting--.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*